US009161620B2

(12) United States Patent
Nicholson

(10) Patent No.: US 9,161,620 B2
(45) Date of Patent: Oct. 20, 2015

(54) MOBILE SERVING CART WITH ADJUSTABLE HINGES

(71) Applicant: Cambro Manufacturing Company, Huntington Beach, CA (US)

(72) Inventor: Jeff Nicholson, Long Beach, CA (US)

(73) Assignee: Cambro Manufacturing Company, Huntington Beach, CA (US)

( * ) Notice: Subject to any disclaimer, the term of this patent is extended or adjusted under 35 U.S.C. 154(b) by 70 days.

(21) Appl. No.: 13/773,076

(22) Filed: Feb. 21, 2013

(65) Prior Publication Data

US 2013/0270988 A1 Oct. 17, 2013

Related U.S. Application Data

(60) Provisional application No. 61/623,183, filed on Apr. 12, 2012.

(51) Int. Cl.

| | |
|---|---|
| ***A47B 96/00*** | (2006.01) |
| ***A47B 81/00*** | (2006.01) |
| ***A47B 31/00*** | (2006.01) |
| ***E05C 1/14*** | (2006.01) |
| *A47B 88/04* | (2006.01) |
| *E05D 5/02* | (2006.01) |
| *E05D 3/02* | (2006.01) |

(52) U.S. Cl.

CPC ..... *A47B 81/00* (2013.01); *A47B 31/00* (2013.01); *A47B 96/00* (2013.01); *E05C 1/14* (2013.01); *A47B 88/044* (2013.01); *E05D 5/02* (2013.01); *E05D 2003/025* (2013.01); *Y10T 29/49963* (2015.01)

(58) Field of Classification Search

CPC ..... A47B 81/00; A47B 96/00; A47B 31/00; A47B 88/044; E05C 1/14; E05D 5/02; E05D 2003/025; E05D 15/00; E05D 2700/10

USPC ..... 312/249.1, 249.8, 249.11, 326, 329, 312/257.1, 109, 409, 400; 16/268

See application file for complete search history.

(56) References Cited

U.S. PATENT DOCUMENTS

| | | | | | |
|---|---|---|---|---|---|
| 1,170,106 | A | * | 2/1916 | Rockwell | 16/268 |
| 1,315,417 | A | * | 9/1919 | Rockwell | 16/268 |
| 2,127,111 | A | * | 8/1938 | Gaenzle | 52/404.4 |
| 2,686,704 | A | * | 8/1954 | Wolters | 312/257.1 |
| 3,110,536 | A | * | 11/1963 | Costantini et al. | 312/350 |
| 3,716,284 | A | * | 2/1973 | Vogt | 312/334.4 |
| 4,662,111 | A | * | 5/1987 | Romberg | 49/364 |

(Continued)

*Primary Examiner* — James O Hansen

(74) *Attorney, Agent, or Firm* — Marcus C. Dawes; Daniel L. Dawes

(57) ABSTRACT

A mobile serving cart with adjustable hinges that allows for the production inconsistencies associated with rotational molding. The cart comprises a plurality of door assemblies, each door assembly comprising at least two hinge assemblies, at least one hinge assembly being disposed at the upper portion of the door assembly, and at least one other hinge assembly being disposed at the lower portion of the door assembly. Each hinge assembly comprises at least two door bolts, at least one cart bolt, and a pivot rod. The cart rod is disposed between the at least two door bolts at an orientation that is orthogonal to the at least two door bolts. The hinge assemblies provide a means for the rotationally molded door assemblies and side walls of the cart to be tightly or snuggly coupled together despite the manufacturing inconsistencies inherent to the rotational molding process.

11 Claims, 12 Drawing Sheets

(56) References Cited

U.S. PATENT DOCUMENTS 4,864,688 A * 9/1989 Gerber ..... 16/261
5,048,902 A * 9/1991 Daly ..... 312/249.8
5,249,857 A * 10/1993 Suzuki ..... 312/263
5,470,143 A * 11/1995 Gill ..... 312/334.4
5,519,920 A * 5/1996 Runge et al. ..... 16/367
6,178,694 B1 * 1/2001 Wagnitz ..... 49/55
6,378,642 B1 * 4/2002 Sutton ..... 180/208
2002/0171332 A1 * 11/2002 Skov et al. ..... 312/107

* cited by examiner

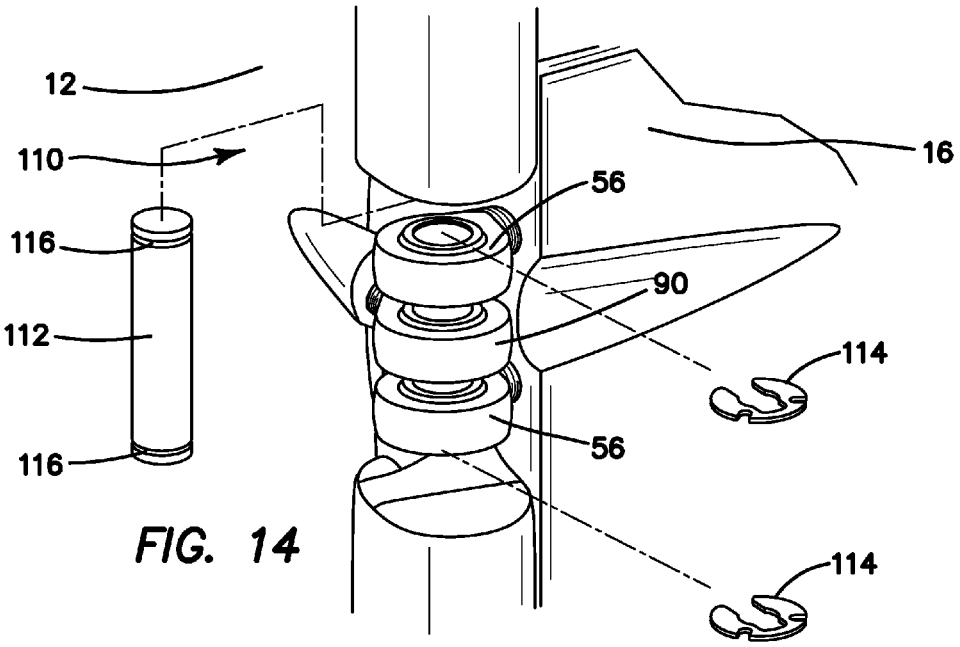
FIG. 14
FIG. 15
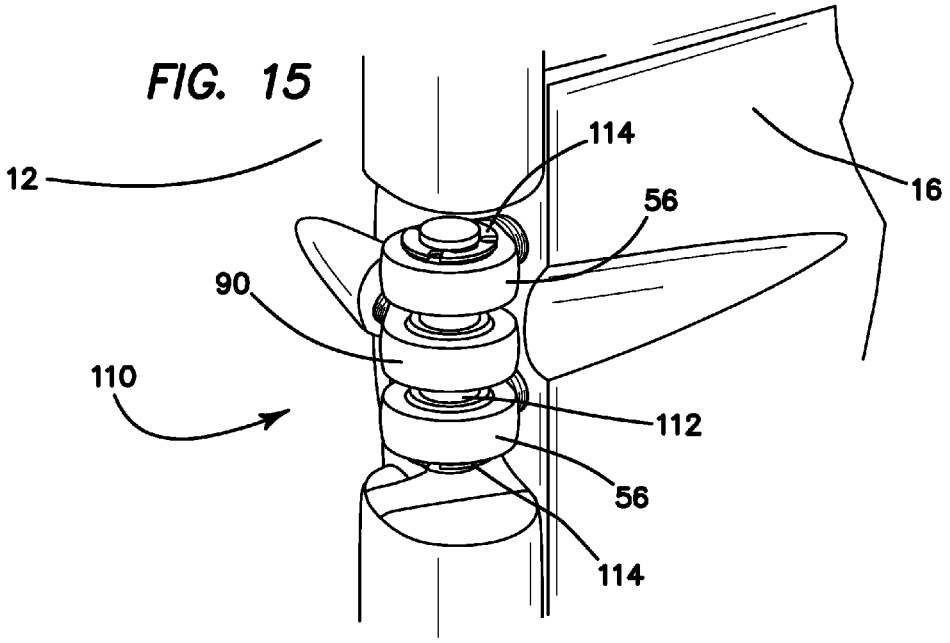

MOBILE SERVING CART WITH ADJUSTABLE HINGES

RELATED APPLICATIONS

The present application is related to U.S. Provisional Patent Application Ser. No. 61/623,183, filed on Apr. 12, 2012, which is incorporated herein by reference and to which priority is claimed pursuant to 35 USC 120.

BACKGROUND

1. Field of the Technology

The disclosure relates to the field of mobile serving carts, specifically mobile serving carts which allow for the natural inconsistencies and irregularities associated with rotational molding fabrication.

2. Description of the Prior Art

Rotational molding is a long known method for producing various products comprised principally of plastic and plastic composites. Typically, a shot of material is inserted within a mold which is then heated as it is rotated about at least one axis. As the mold is heated and rotated, the material spreads and fills every aspect and contour within the mold, producing a finished product dictated by the mold itself. Using rotational molding, everything from cooking utensils to storage containers can be quickly and cheaply made on an industrial scale.

However, a drawback commonly associated with rotational molding production is that due to small differences in pressure, temperature, and material purity, it is often difficult to maintain universal or consistent production between each piece that is made. This is particularly true when small or intricate detail is required within the product.

The problem of inconsistent production can often be frustrating to manufacturers, however this problem is made noticeably worse when rotationally molded products require several different parts as non-uniform components may render the product more difficult to use or even worthless.

For example, as applied to rotationally molded mobile serving carts, many current designs require a rotationally molded door to be coupled to its frontal façade. However due to production inconsistencies, a rotationally molded door may be too large or misshapen and not always fit the serving cart it was designed for in the exact manner as was intended. Production inconsistencies not only make assembly of the final product more difficult, but they may even make components of the mobile serving cart inappropriate for its intended purpose, rendering the component worthless. This common problem decreases efficiency and increases the cost of production which in turn increases the costs for consumers interested in purchasing the serving cart.

What is needed therefore is a mobile serving cart that is functional, easy to use, and compensates for the production inconsistencies that are inherent with rotational molding fabrication.

BRIEF SUMMARY

The invention includes a mobile serving cart with a plurality of adjustable hinges. The mobile serving cart comprises a plurality of side walls and a plurality of door assemblies removably coupled to at least one of the plurality of side walls. The door assemblies and side walls cooperate to form a plurality of adjustable hinge assemblies, each hinge assembly including a cart bolt coupled to the side wall which is disposed between a pair of door bolts coupled to the door assembly.

In one embodiment, for each hinge assembly the cart bolt coupled to the side wall is orthogonally orientated with respect to the pair of door bolts coupled to the door assembly. The cart bolt and the pair of door bolts comprise means for being coupled to the side wall and the door assembly respectively at a continuous plurality of depths. Each hinge assembly further includes a pivot rod which is threaded through a circular aperture defined in each of the door bolts and the cart bolt. The hinge assembly further includes means for locking the pivot rod in a fixed position through the circular apertures defined in each of the door bolts and the cart bolt.

In another embodiment, the cart bolt and the pair of door bolts of the hinge assembly each comprise a pivoted core disposed in the center of a spherical bearing within each rod.

In a related embodiment, the mobile serving cart further includes a plurality of ringed spacers threaded over the pivot rod and disposed between the cart bolt and the pair door bolts.

In yet another embodiment, each door assembly of the mobile serving cart includes a spring loaded handle, a heating insert, and a thermometer.

The invention further includes a method for adjusting a hinge assembly between a door assembly and a side wall of a mobile serving cart. The method includes inserting a cart bolt into the side wall of the mobile serving cart and then inserting a pair of door bolts into the door assembly. The pair of door bolts is then aligned with the cart bolt, and then the pair of door bolts and cart bolt are adjusted with at least six degrees of freedom to produce a common vertical axis between the pair of door bolts and the cart bolt. Finally, the common vertical axis between the pair of door bolts and the cart bolt are locked into place.

In one embodiment, the method step of inserting the cart bolt into the side wall of the mobile serving cart includes threading the cart bolt into a cart aperture to a desired depth, and likewise threading the pair of door bolts into a corresponding pair of door apertures to a desired depth.

In one particular embodiment, the method step of aligning the pair of door bolts with the cart bolt includes disposing the cart bolt in between the pair of door bolts at an orthogonal orientation with respect to the door bolts.

In one embodiment, adjusting the pair of door bolts and cart bolt with at least six degrees of freedom to produce a common vertical axis includes aligning a circular aperture defined through each of the door bolts and the cart bolt into a common vertical axis. The axis of each of the circular apertures may be pivoted relative to the remainder of any of the door bolts or cart bolt, the horizontal displacement of the circular apertures may be adjusted by adjusting the depth of any of the door bolts or cart bolt, or the vertical displacement of the circular apertures may be adjusted by disposing a plurality of spacers between the door bolts and the cart bolt in order to produce the common vertical axis.

In another embodiment, the method step of locking the common vertical axis between the pair of door bolts and the cart bolt into place includes disposing a pivot rod through a circular aperture defined through the pair of door bolts and the cart bolt. A clip or a nut may then be disposed on either end of the pivot rod.

In yet another embodiment, the method also includes adjusting a plurality of hinge assemblies between a plurality door assemblies and the side wall of the mobile serving cart.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The disclosure can be better visualized by turning now to the following drawings wherein like elements are referenced by like numerals.

BRIEF DESCRIPTION OF THE DRAWINGS

FIG. 14 is a perspective view of the hinge assembly seen in FIG. 13A with an alternative embodiment of the pivot rod removed from the hinge assembly.

FIG. 15 is a magnified view of an alternative embodiment of the hinge assembly comprising a pair of clips.

The disclosure and its various embodiments can now be better understood by turning to the following detailed description of the preferred embodiments which are presented as illustrated examples of the embodiments defined in the claims. It is expressly understood that the embodiments as defined by the claims may be broader than the illustrated embodiments described below.

DETAILED DESCRIPTION OF THE PREFERRED EMBODIMENTS

Figure 1:
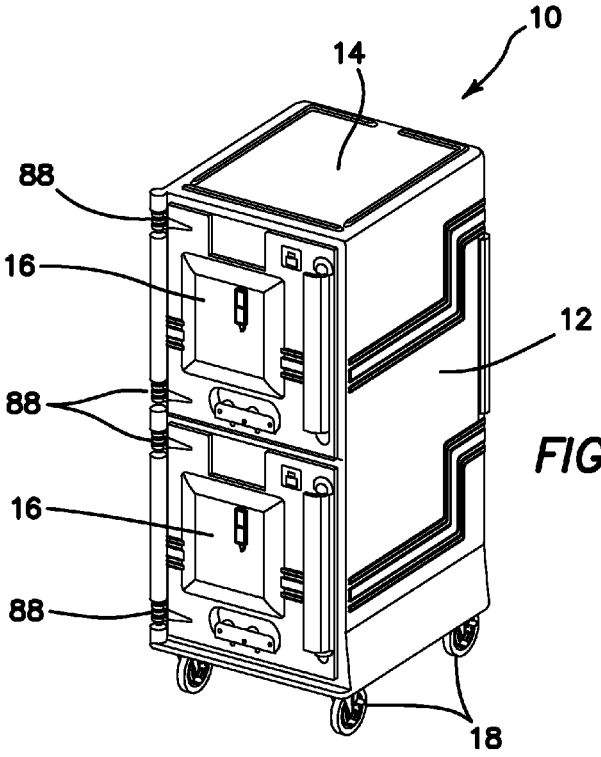
FIG. 1 is a perspective view of the mobile serving cart.
Figure 2:
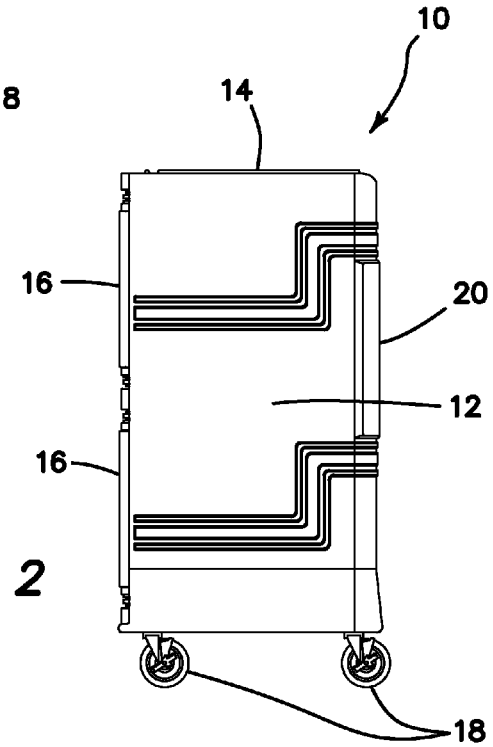
FIG. 2 is a side view of the mobile serving cart seen in FIG. 1.

The current invention is a mobile serving cart with adjustable hinges that allows for the production inconsistencies associated with rotational molding and is shown in perspective view in FIG. 1 under general reference numeral 10. The cart 10 comprises of plurality of side walls 12 and a top portion 14 which form a substantially rectangular shape as seen in FIGS. 1 and 2. The cart 10 also comprises a rear wall 20 which forms a "back" portion of the cart 10, and a plurality of door assemblies 16 which form the "front" portion of the cart 10 as best seen in FIG. 2. The cart 10 further comprises a plurality of casters 18 coupled to its bottom portion which allow the cart 10 to be mobile and to be physically manipulated into position by a user. The basic form of the side walls 12, top portion 14, and door assemblies 16 are comprised of plastic and formed by rotational molding. It is preferred that the cart 10 and its various components are comprised of rotationally molded Polyethylene plastic, however other types or compositions of plastic now known or later devised may be used without departing from the original spirit and scope of the invention. Additionally, in order to insulate the cart 10, the interiors of the side walls 12 and door assemblies 16 are preferably filled with Polyurethane foam, however other materials now known or later devised within the field of insulating materials may be used within the original scope of the invention.

It should be noted that FIGS. 1 and 2 depict two door assemblies 16 in a substantially "stacked" configuration, however this is meant to be for illustrative purposes only. The cart 10 may comprise fewer or additional door assemblies 16 in other configurations other than what is explicitly shown without departing from the original spirit and scope of the invention.

Figure 3:
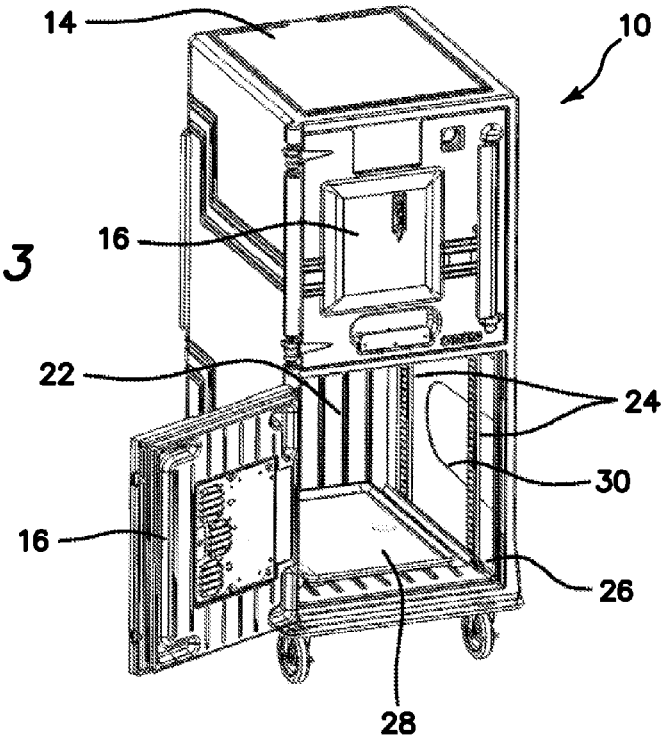
FIG. 3 is a perspective view of the mobile serving cart seen in FIG. 1 with one of the plurality of door assemblies in the open position.

FIG. 3 shows the cart 10 with the top door assembly 16 in the closed position, and the bottom door assembly 16 in the open position exposing an interior volume 22 within the cart 10. The cart 10 may comprise an individual interior volume 22 behind each corresponding door assembly 16 as seen in FIG. 3, or alternatively the cart 10 may comprise a single comprehensive interior volume 22 with a plurality of door assemblies 16 providing multiple egress points into the cart 10. As also seen in FIG. 3, each interior volume 22 within the cart 10 comprises a plurality of rail guides 24 disposed on the interior surface 30 of each side wall 12. The rail guides 24 interact with a plurality of tray rails 26 to provide a means for a plurality of trays 28 to be stored within each interior volume 22 of the cart 10.

Figure 4A:
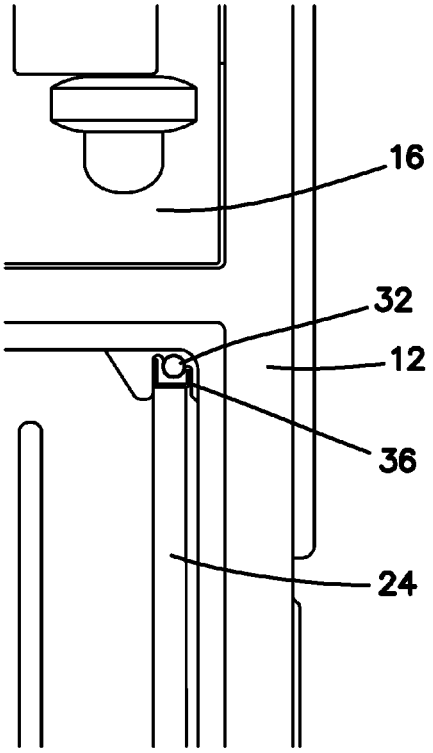
FIG. 4A is a magnified view of the interior volume of the mobile serving cart with the upper portion of a rail guide coupled to interior wall of the mobile serving cart.
Figure 4B:
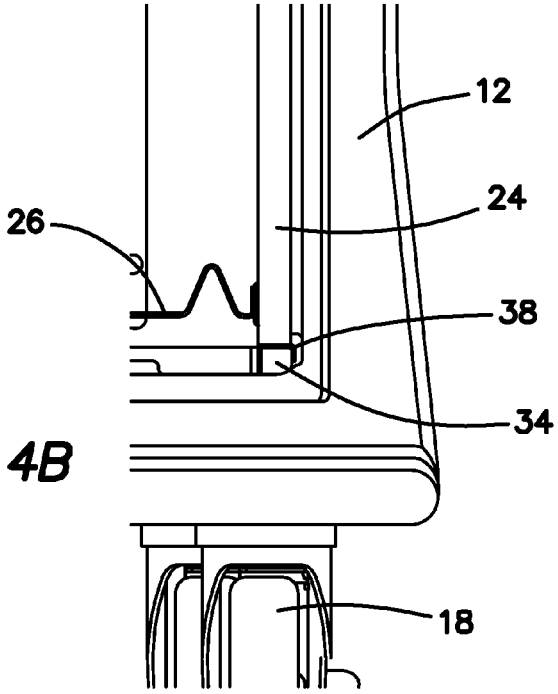
FIG. 4B is a magnified view of the interior volume of the mobile serving cart with the lower portion of a rail guide coupled to interior wall of the mobile serving cart.

As seen in FIGS. 4A and 4B, the rail guides 24 are removably inserted into the cart 10 by inserting each rail guide 24 about an upper mold 32 and a lower mold 34 disposed on the upper and lower surfaces of the interior volume 22, respectively. Each rail guide 24 comprises an upper tip 36 and a lower tip 38, each with a substantially "U" shaped cross section as seen. The upper tip 36 is disposed around the upper mold 32, while the lower tip 38 is disposed around the lower mold 34. The rail guide 24 is then pushed distally back into the interior volume 22 along the side wall 12 until the desired position is achieved. This process is repeated three more times, giving each interior volume 22 a total of four rail guides 24, two disposed on the interior surface 30 of each side wall 12.

Figure 8:
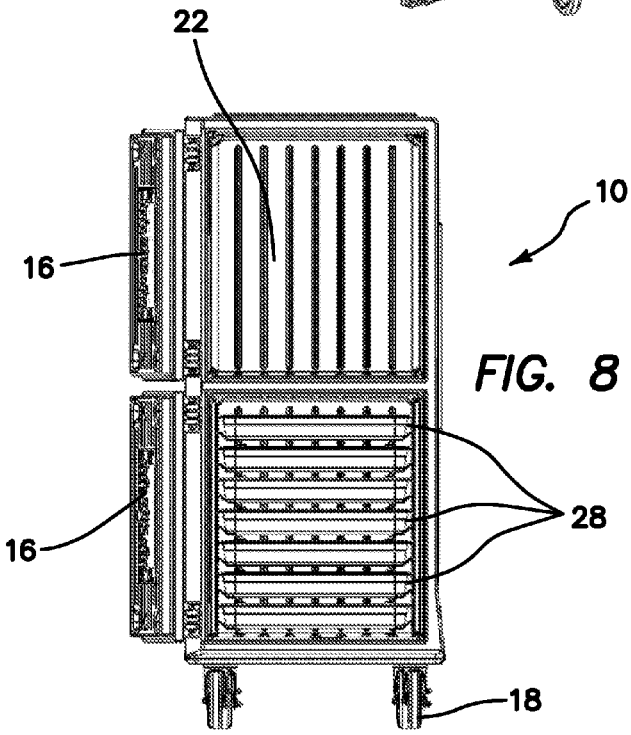
FIG. 8 is a frontal view of the mobile serving cart seen in FIG. 1 with both door assemblies in the open position.
Figure 5A:
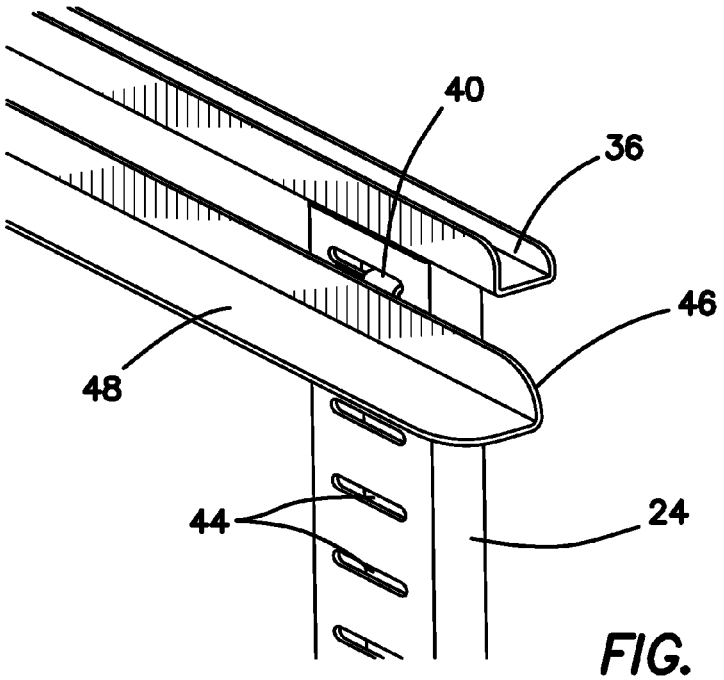
FIG. 5A is a frontal perspective view of a tray rail after being coupled to a rail guide.
Figure 5B:
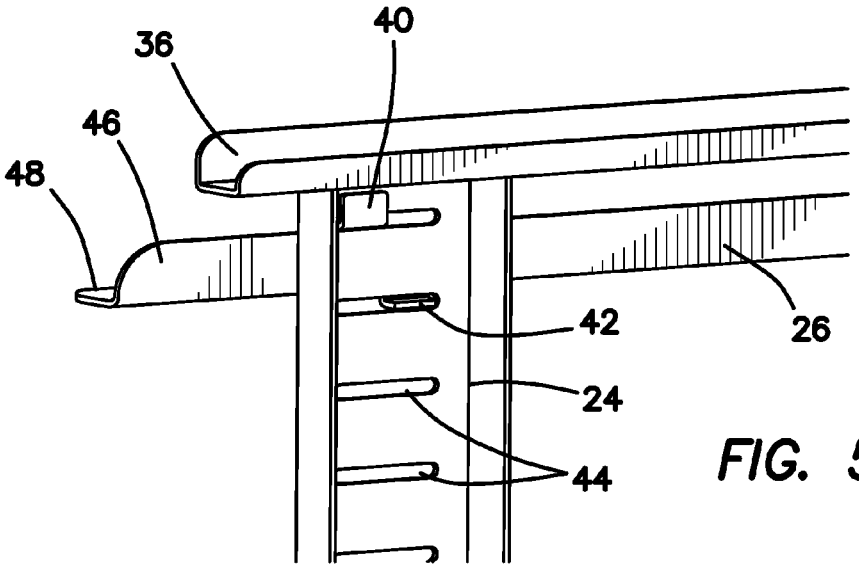
FIG. 5B is a rear perspective view of a tray rail after being coupled to a rail guide.
Figure 16:
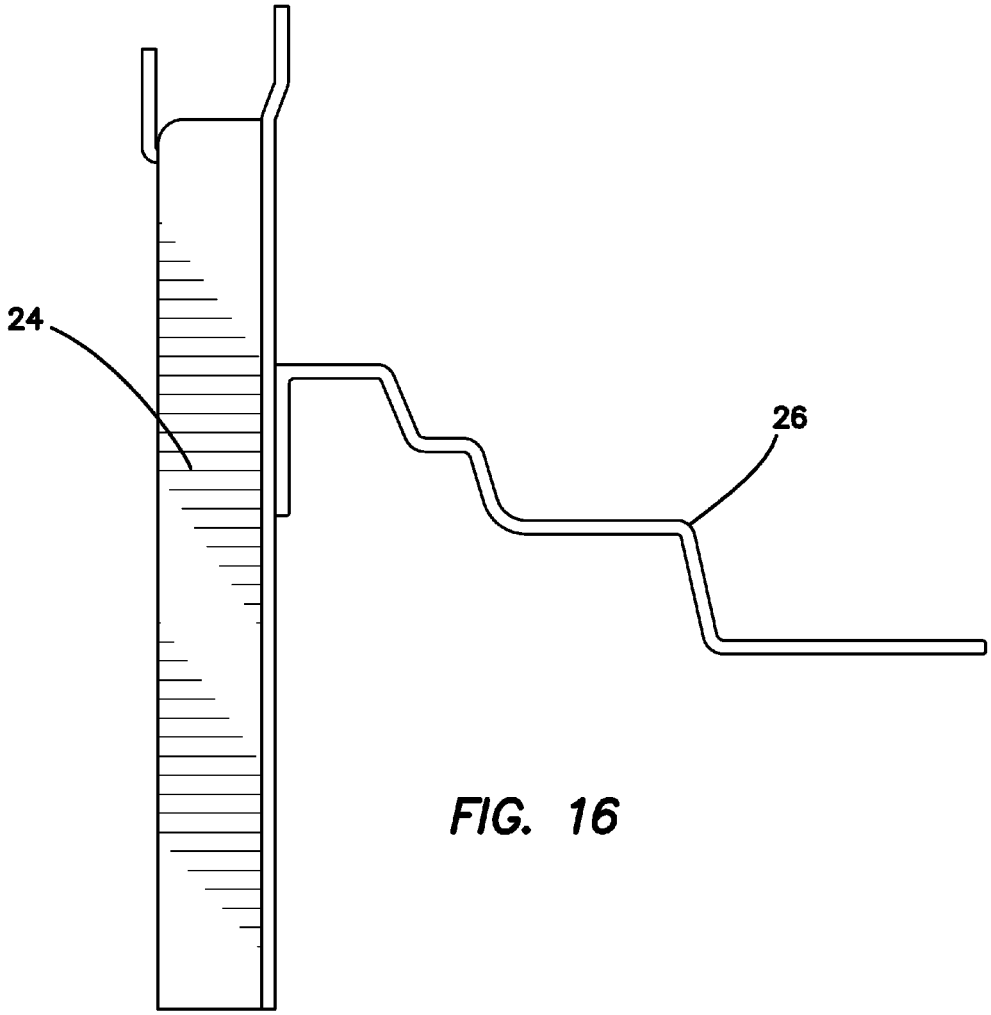
FIG. 16 is a cross sectional view of an alternative embodiment of the tray rails coupled within the mobile serving cart comprising a staggered configuration.

Next, a tray rail 26 is coupled to a pair of rail guides 24 as seen in FIGS. 5A and 5B. Each tray rail 26 is comprised of a vertical flange 46 and a horizontal flange 48 as best seen in FIG. 5A. The vertical flange 46 comprises at least two sets of an upper tab 40 and a lower tab 42 along its length. Each tab set is disposed along the tray rail 26 so as to correspond to the distance between each of the rail guides 24. Each rail guide 24 comprises a plurality of slots 44 defined in series along its height. In order to couple the tray rail 26 to the rail guide 24, the upper tab 40 of each tab set on the vertical flange 46 is inserted into a slot 44, while the lower tab 42 of each tab set is inserted into the slot 44 defined directly beneath the first slot 44 containing the upper tab 40. With the tray rail 26 coupled to two rail guides 24 at two locations, a secure and stable mounting surface is achieved. Another tray rail 26 is then coupled to the rail guides 24 at the same height on the opposing side wall 12 within the interior volume 22. With matching tray rails 26 in place, a user is free to slide a tray 28 or other food service item onto the horizontal flanges 48 for storage within the cart 10. The user may repeat this entire process and couple an even plurality of tray rails 26 to the rail guides 24 for as many trays 28 that require storage within the cart 10. FIG. 8 shows the cart 10 with both door assemblies 16 in the open position exposing each interior volume 22 in two different configurations. The upper interior volume 22 is left empty and functions as a general storage space while the lower interior volume 22 has been filled with a plurality of trays 28 and tray rails 26. It should be understood however that other configurations other than what is explicitly shown are also contemplated without departing from the original spirit and scope of the invention. For example, in one possible embodiment both the interior volumes 22 of the cart 10 may be completely or partially filled with trays 28 as needed, while in a separate embodiment, no trays 28 may be present within the cart 10 at all. In still a further embodiment, the tray rails 26 and rail guides 24 are comprised of stainless steel and are permanently coupled within the interior volumes 22 of the cart 10, giving the cart 10 a fixed configuration for a specific purpose of use. It should be further understood that that the specific shape or configuration of the tray rails 26 may also be different from what is explicitly shown within the drawings. For example, in an alternative embodiment shown in FIG. 16, the tray rails 26 may comprise a substantially "stepped" or staggered shape as seen so as to accommodate a plurality of different tray sizes or styles. Other tray rail shapes other than what is seen are also possible without departing from the original spirit and scope of the invention.

Figure 6:
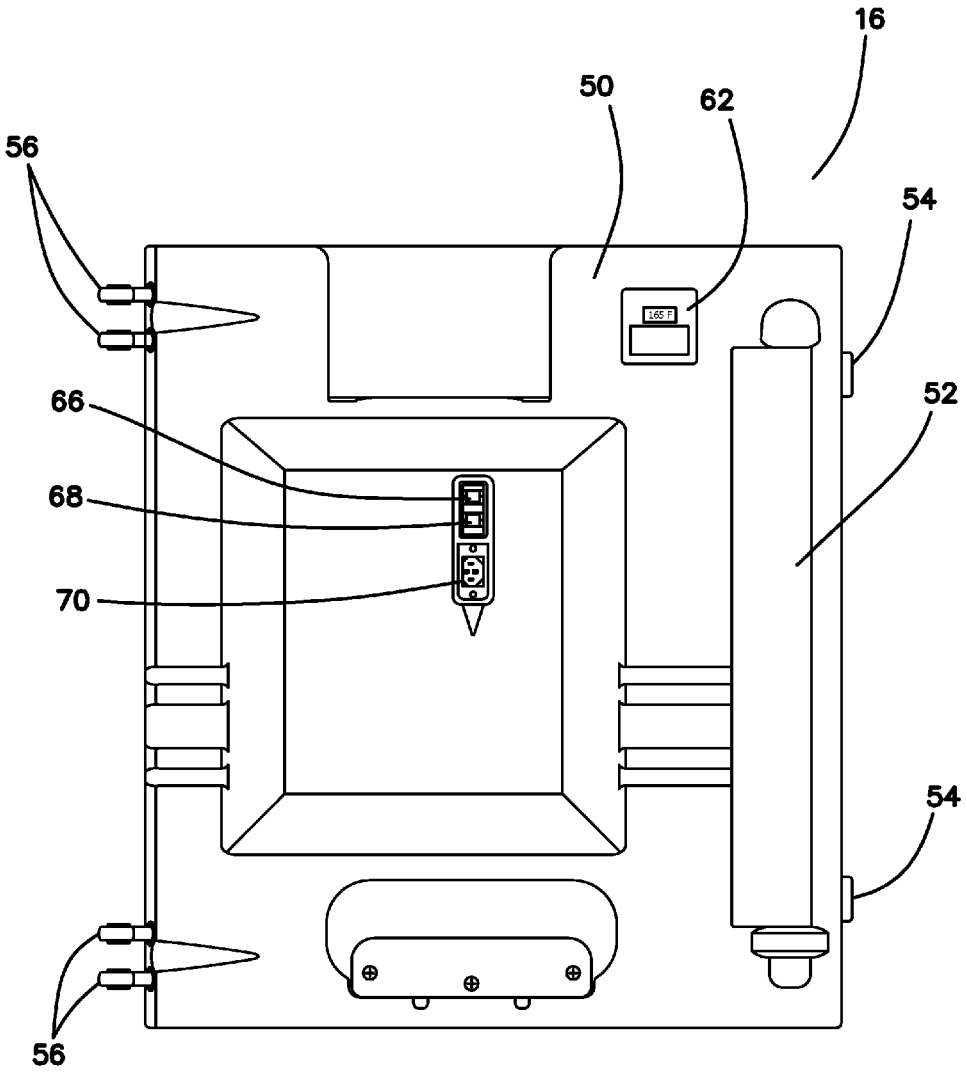
FIG. 6 is a frontal view of a door assembly of the mobile serving cart seen in FIG. 1.
Figure 7:
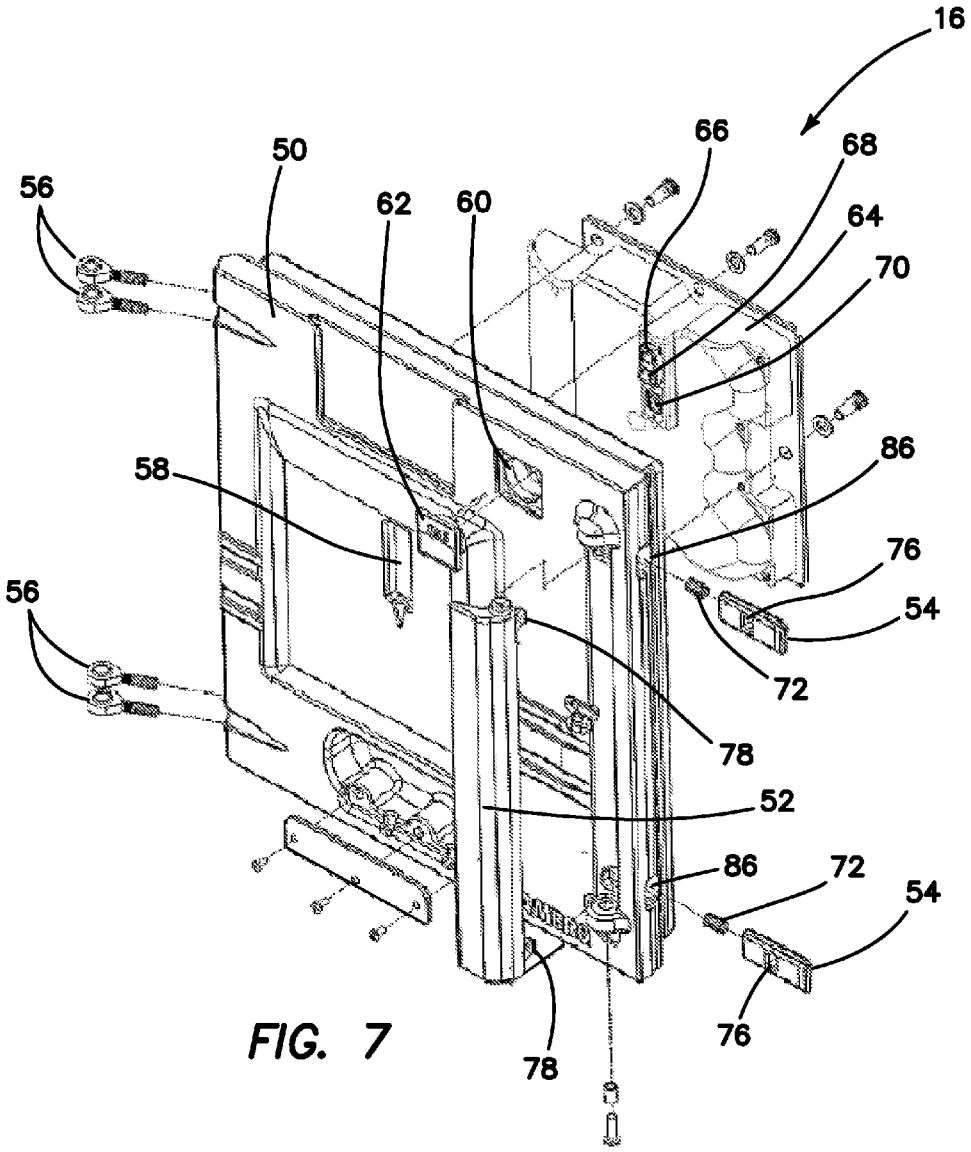
FIG. 7 is an exploded perspective view of the door assembly seen in FIG. 6.

Greater detail of the door assembly 16 may be had by turning to FIGS. 6 and 7. The door assembly 16 is substantially rectangular in shape and is comprised principally of rotationally molding plastic or plastic composites. The door assembly 16 comprises a door housing 50 which serves as a platform for maintaining and housing a plurality of features. Coupled to the door housing 50 is a handle 52 which is vertically placed on the right-hand portion of the door housing 50 and is used to open and close the door assembly 16 with respect to the cart 10. Disposed in the left-hand edge of the door housing 50 are a plurality of door bolts 56, two door bolts 56 being disposed in close proximity near the top of the door housing 50, and two additional door bolts 56 disposed in close proximity near the bottom of the door housing 50 as seen in FIG. 6. Disposed within the right-hand portion of the door housing 50 is a pair of slide bolts 54 and a corresponding pair of springs 72 which are arranged to interact with the handle 52 as is further detailed below.

The door housing 50 also comprises a power aperture 58 as well as a thermometer aperture 60 defined into surface as best seen in FIG. 7. The thermometer aperture 60 houses a digital thermometer 62 which is removably inserted into the door assembly 16. The thermometer 62 breaches the thickness of the door housing 50 allowing it to monitor and then display the internal temperature of the interior volume 22 located directly behind it.

Figure 9:
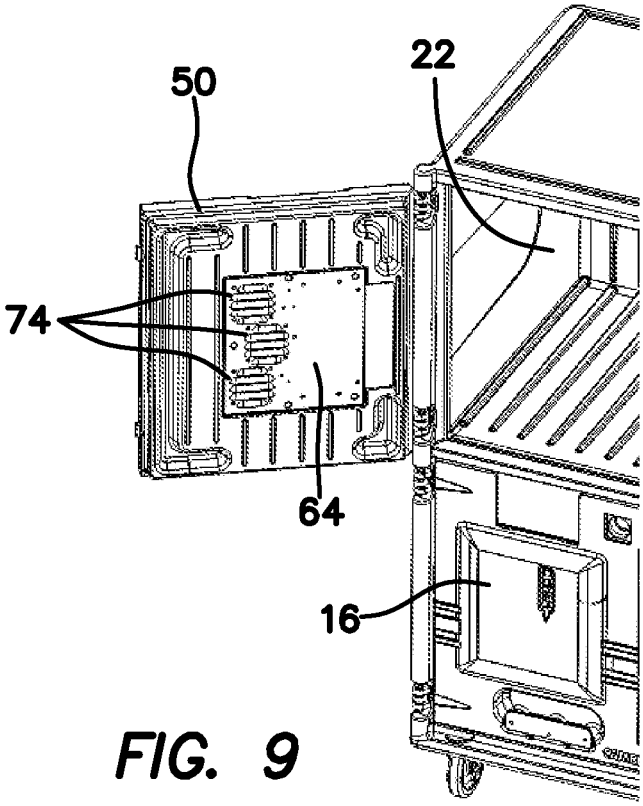
FIG. 9 is a perspective view of the mobile serving cart seen in FIG. 1 with the top door assembly in the open position, exposing the serving insert disposed therein.

In one particular embodiment, the mobile serving cart 10 may be used as a heating cart to heat or otherwise maintain food items at elevated temperatures. Here, the door assembly 16 comprises a heating insert 64 which is comprised of a convection type heater or other known source of heat which is coupled to the rear of the door housing 50. Disposed on the heating insert 64 is a power LED 66, a heater LED 68, and a power socket 70. When the heating insert 64 is coupled to the rear of the door housing 50 as seen in FIG. 9, the power LED 66, heater LED 68, and power socket 70 are pushed into the power aperture 58 from the rear, allowing access to them by a user in front of the door assembly 16. Power may be applied to the heating insert 64 by coupling a conventional power cable to the power socket 70 via the power aperture 58. When the door assembly 16 is in the closed configuration as seen in FIG. 1 and supplied with power, the heating insert 64 applies heat to the contents contained within the interior volume 22 through a plurality of vents 74 disposed on the rear of the heating insert 64 as best seen in FIG. 9. The thermal insulation of the cart 10 helps maintain the heat generated by the heating insert 64 by limiting the amount of heat transfer between the cart 10 and the outside environment, thereby increasing its overall efficiency.

Figure 10A:
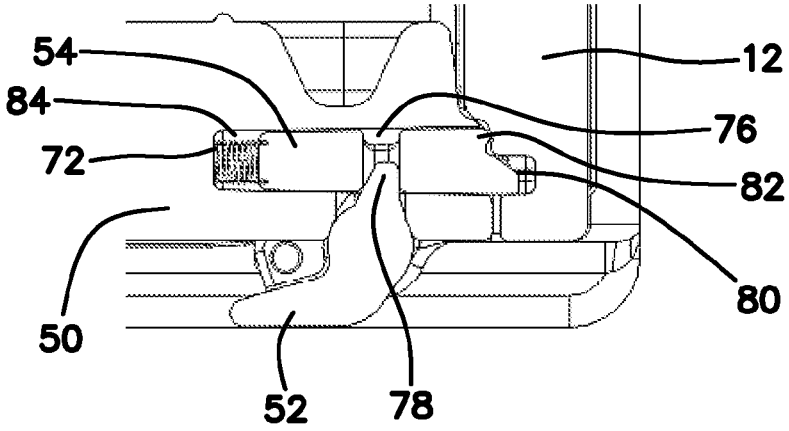
FIG. 10A is a top-down cross section of the latch assembly and handle disposed in each of the door assemblies of the mobile serving cart, the door assembly being in the closed position.
Figure 10B:
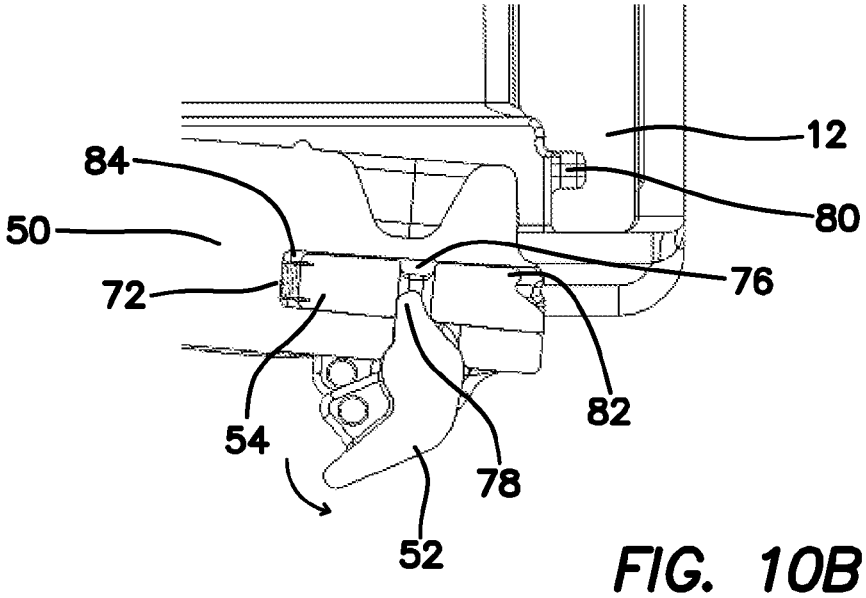
FIG. 10B is a top-down cross section of the latch assembly and handle disposed in each of the door assemblies of the mobile serving cart, the door assembly being in the open position.

Greater detail of the latch assembly and handle 52 may be had by turning to FIGS. 10A and 10B. The handle 52 coupled to each door assembly 16 is comprised of rotationally molded plastic and serves as a long, vertical means for a user to open and close the door assembly 16 with respect to the remainder of the cart 10. The handle 52 also comprises a pair of protruding horns 78 at its top and bottom portions as seen in FIG. 7.

The handle 52 is coupled to the outer surface of the door housing 50, but the horns 78 are orientated to protrude into a molded cavity 84 defined within the door housing 50 as seen in FIGS. 10A and 10B. The cavity 84 is a fixed hollow volume within the door housing 50, and as seen in FIG. 7, comprises an opening 86 facing the jamb of the door assembly 16. The cavity 84 serves as a means for housing a slide bolt 54 and a spring 72. The spring 72 is disposed between the slide bolt 54 and the edge of the cavity 84 so as to provide a bias against the slide bolt 54 in the direction of the opening 86. Each slide bolt 54 comprises a horn aperture 76 defined in its center.

The horns 78 of the handle 52 not only extend into the cavity 84, but also into the horn aperture 76 of the slide bolt 54, thus providing a means of interaction between the handle 52 and the slide bolt 54. As the handle 52 is rotated by a user, the horns 78 likewise rotate in the same direction, thus pulling and pushing the slide bolt 54 in and out of the cavity 84 through the opening 86. For example, in FIG. 10B the handle 52 is rotated counterclockwise which causes the horns 78 to rotate counterclockwise against the slide bolt 54, pulling them deeper into the cavity 84 and compressing the spring 72. Conversely, as the handle 52 is rotated in the clockwise direction, the horns 78 push against the slide bolt 54, extending it further out of the cavity 84 through the opening 86. This process occurs simultaneously in both the upper and lower slide bolts 54 within the door housing 50, providing each door assembly 16 means for coupling the cart 10 at at least two points.

The latch assembly comprising the handle 52, slide bolt 54, spring 72, and cavity 84 not only serve as a means for a user to open and close the door assemblies 16, but also as a means to securely maintain the door assembly 16 in a closed position. As seen in FIG. 10A, when the door assembly 16 is in the closed position, the door housing 50 is flush with the adjacent side wall 12 of the cart 10. The slide bolt 54 comprises a shaped head 82 which interacts with a correspondingly shaped pocket 80 defined into the side wall 12 to prevent any movement of the slide bolt 54 within the shaped pocket 80 without first actuation of the handle 52. The spring 72 provides a bias against the slide bolt 54 which ensures that the head 82 of the slide bolt 54 stays in physical contact with the shaped pocket 80 for as long as the door assembly 16 is in the closed position. Additionally, the shaped head 82 of the slide bolt 54 facilitates the closing of the door assembly 16 by "slipping" or otherwise providing a flexible means for pushing the door assembly 16 against the side wall 12 of the cart 10, and then maintaining the door assembly 16 in a closed or locked position by instantly returning to its position against the inner contours of the pocket 80 as seen in FIG. 10A via the actuation of the spring 72.

For a door assembly 16 to be opened, the handle 52 is gripped by a user and rotated in the counterclockwise direction as indicated by the arrow in FIG. 10B. The horns 78 likewise rotate within the horn aperture 76 and pull the slide bolts 54 out of the pocket 80, thus disengaging the shaped head 82 from the interior molding of the pocket 80. As the slide bolts 54 are brought deeper into the cavity 84 as seen in FIG. 10B, the spring 72 is further compressed. As the door assembly 16 is closed, the door housing 50 is first brought back near the side wall 12 of the cart 10, thus re-aligning the cavity 84 containing the slide bolt 54 with the pocket 80 defined in the side wall 12. The user then releases or rotates the handle 52 in the clockwise direction, thus rotating the horns 78 against the opposing sides of the slide bolts 54 and pushing them back out of the cavity 84 and into the pocket 80. With the assistance of the expanding spring 72, each slide bolt 54 extends fully into the pocket 80 until contact is made between the shaped head 82 and the inner contours of the pocket 80.

Greater understanding of the hinge assemblies 88 may be had by turning to FIGS. 11-13B. Each door assembly 16 comprises at least two hinge assemblies 88, at least one hinge assembly 88 being disposed at the upper portion of the door assembly 16, and at least one other hinge assembly 88 being disposed at the lower portion of the door assembly 16. Each hinge assembly 88 comprises at least two door bolts 56, at least one cart bolt 90, a pair of end bolts 92, and a pivot rod 94 which is seen in the exploded view of FIG. 11. The hinge assemblies 88 provide a means for the rotationally molded door assemblies 16 and side walls 12 of the cart 10 to be tightly or snuggly coupled together despite the manufacturing inconsistencies inherent to the rotational molding process.

Figure 11:
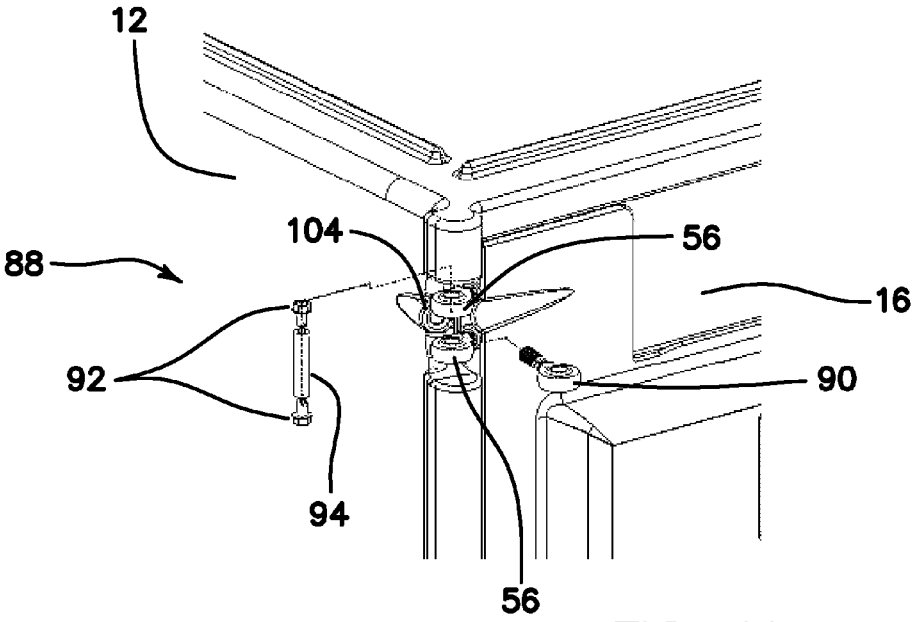
FIG. 11 is a semi-exploded perspective view of the hinge assembly coupling the door assembly to the mobile serving cart.
Figure 12:
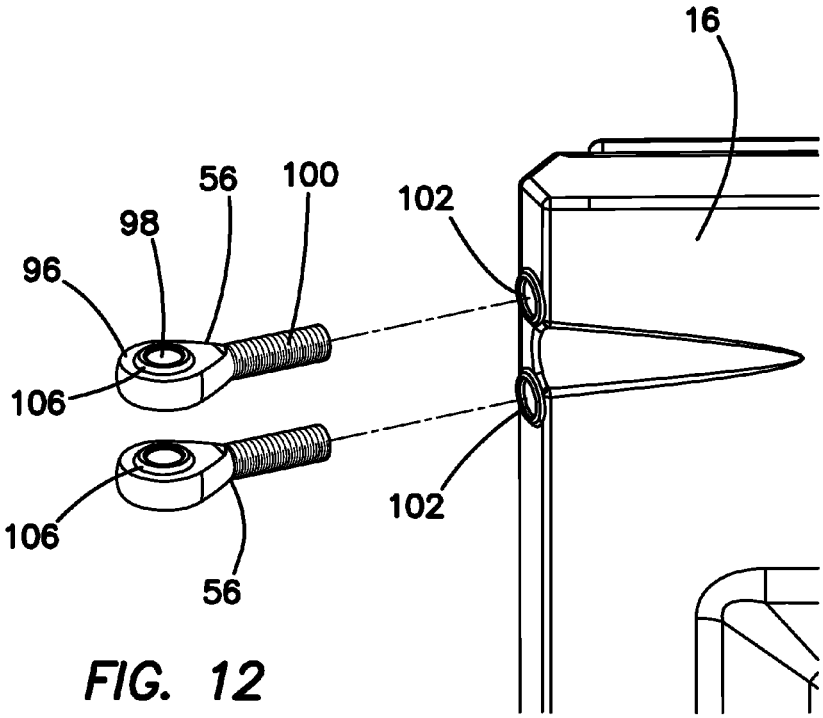
FIG. 12 is an exploded view of the door bolts which are disposed in a corresponding plurality of door apertures defined within the door assembly.

As seen in FIG. 12, each door bolt 56 comprises a substantially spherical bearing 96 with a pivoted core 106 disposed in its center. The spherical bearing 96 in some embodiments may also be a portion of a sphere, a portion of a hemisphere, or the segment of a circle. The pivoted core 106 comprises a circular aperture 98 defined through its center and acts as a sort of gimbal, meaning that the pivoted core 106 is free to move about within the spherical bearing 96, thus adjusting axis of the circular aperture 98. Each door bolt 56 also comprises a threaded distal portion 100 that engages with a corresponding door aperture 102. In each door assembly 16 present, there are a total of four door bolts 56, two in each hinge assembly 88. Similarly, as shown in FIG. 11, the cart bolts 90 which are substantially similar to the door bolts 56, are threadably engaged in a cart aperture 104. Each cart aperture 104 and door aperture 102 is a threaded plug which is inserted into a pre-defined hole within the side wall 12 and door assembly 16, respectively. Each hinge assembly 88 comprises at least one cart bolt 90, thereby giving each hinge assembly 88 a total of at least three rods, specifically two door bolts 56 and one cart bolt 90. The distal threaded portions 100 of the rods 56, 90 allow the rods 56, 90 to be inserted within the door apertures 102 and cart aperture 104 respectively at varying depths, allowing for a large range of movement to help locate the door assembly 16 over the opening of the interior volume 22 of the cart 10.

Figure 13A:
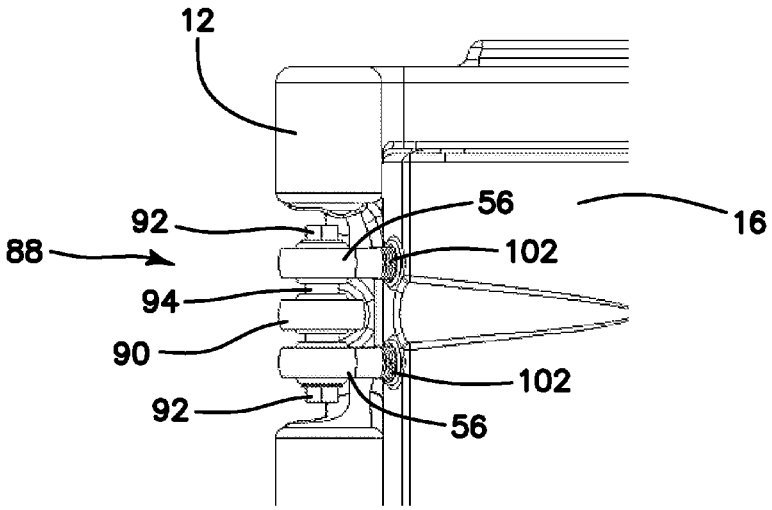
FIG. 13A is a frontal view of the hinge assembly seen in FIG. 11.
Figure 13B:
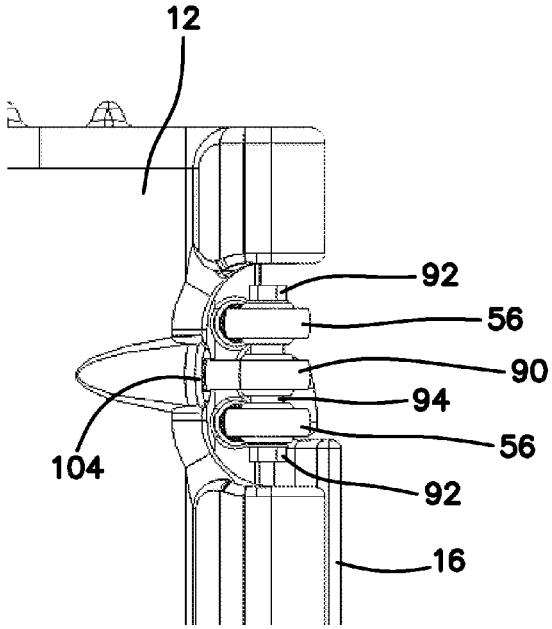
FIG. 13B is a side view of the hinge assembly seen in FIG. 13A.

The door bolts 56 and cart bolt 90 of each hinge assembly 88 cooperate to from a flexible, adjustable means for the door assembly 16 to be placed in the correct configuration with respect to the side wall 12 of the cart 10 and to provide a tight seal around each interior volume 22. As best seen in FIGS. 13A and 13B, the door bolts 56 are orientated within the door assembly 16 at an angle which is substantially perpendicular or orthogonal with respect to the orientation of the cart bolt 90 inserted into the side wall 12. Furthermore, the cart bolt 90 is inserted into the cart aperture 104 in between each of the door bolts 56 so as to be "sandwiched" there between and so as to substantially align each of the circular apertures 98 of the door bolts 56 and cart bolt 90 along a common vertical axis. In a related embodiment, the hinge assembly 88 may comprise a reversed configuration to that described above, specifically the side wall 12 of the cart 10 may comprise two cart bolts 90 and the door assembly 16 may comprise only a single door bolt 56. In this embodiment, the single door bolt 56 is disposed or "sandwiched" between the pair of cart bolts 90 at an orientation that is perpendicular or orthogonal to that of the cart bolts 90.

Each of the door bolts 56 and the cart bolt 90 may be inserted at different varying depths within their respective apertures 102, 104 so that a door assembly 16 which is slightly askew may be adjusted both vertically and horizontally with respect to the frame of the cart 10. The door bolts and cart bolt 56, 90 are easily removable so that they may be finely tuned or corrected as needed in order to properly couple the door assembly 16 to the cart 10. With the door bolts 56 inserted into the door apertures 102, and the cart bolt 90 inserted into the cart aperture 104, the pivot rod 94 is then inserted through each of the aligned circular apertures 98 as seen in FIGS. 13A and 13B. The door assembly 16 is then adjusted up or down with respect to cart bolt 90 in the side wall 12 with the door bolts 56 sliding about the pivot rod 94. The angle between the door assembly 16 and the side wall 12 of the cart 10 may also be adjusted by maneuvering the pivot rod 94 within each of the pivoted cores 106 disposed in each of the door bolts and cart bolt 56, 90. By adjusting the pivot rod 94 within the pivoted core 106, slight differences in angle between the door assembly 16 and the side wall 12 may be compensated for. The door assembly 16 is adjusted until the proper fit or seal about the interior volume 22 is obtained between the door assembly 16 and the cart 10, and until all three circular apertures 98 of each hinge 88 are aligned in a substantially vertical orientation. The combination of the variable depth of the cart bolts 90 and door bolts 56, the vertical placement along the pivot rod 94, and the ability to pivot or gimbals the pivot rod 94 at an angle within each of the hinges 88, allows the user to precisely adjust and manipulate the coupling of the door assembly 16 to the side wall 12 of the cart 10 in three dimensions with at least six degrees of freedom, including nearly every possible angular orientation possible between the door assembly 16 and the cart 10. This ability allows the user to compensate for nearly every possible fabrication flaw that may be present from the rotational molding process in which the components of the cart 10 were made. This flexibility not only makes the cart 10 easier to manufacture, but saves on construction costs since parts which normally would have to be discarded, may now be used without any significant alteration or additional fabrication steps.

When the desired position of the door assembly 16 has been reached, end bolts 92 are inserted into the top and bottom of the pivot rod 94, thus locking the hinge assembly 88 into its current position. It should also be expressly noted that other fastening means now known or later devised such as retaining rings or clips may be used to prevent the pivot rod 94 from slipping from the hinge assembly 88. When the same is repeated for both the upper and lower hinge assemblies 88, the door assembly 16 is thus securely coupled to the cart 10, allowing it to be operated as standard cabinet or cart door as known in the art. As the latch is actuated via the handle 52 as discussed above and the door assembly 16 is opened or closed, the pivot rod 94 and cart bolt 90 remained fixed, while the door bolts 56 disposed above and below the card rod 90 rotate with the rest of the door assembly 16.

Additionally in a further embodiment, washers or ringed spacers may be threaded over the pivot rod 94 and placed in between each of the rods 56, 90 as needed so as to provide additional spacing and structural support within the hinge assembly 88. The spacers in some situations may help correct the vertical displacement of the door assembly 16 with respect to the cart 10, thereby rendering what otherwise may have been an unusable rotationally molded door assembly 16 into a functional component of the cart 10. The spacers may all be the same thickness, or a variety of thicknesses depending upon what is required.

An alternative embodiment of the hinge assembly 110 may be seen in FIGS. 14 and 15. Here the pivot rod 112 comprises a groove 116 defined at either end as best seen in FIG. 14. After the pivot rod 112 has been inserted through the door bolts 56 and the cart bolt 90 as discussed above, the grooves 116 are left exposed above and below the upper door bolt 56 and lower door bolt 56, respectively. A pair of clips 114 are then inserted into each of the grooves 116 of the pivot rod 112. The clips 114 are substantially "U" shaped and comprise means for maintaining a tight and secure fit about the pivot rod 112 via the grooves 116. With each clip 114 in place as seen in FIG. 15, the door bolts 56 and cart bolt 90 are locked into position, thus forming the hinge assembly 110. The door assembly 16 may then be operated as discussed above, namely by rotating the door assembly 16 about the hinge assembly 110 with respect the remainder of the cart 10.

The mobile serving cart 10 can be used in two general ways, as a "passive containment" device that may used to hold or contain a variety of food stuffs within an insulated container unit, or as a "heating containment" device that applies heat to a variety of food stuffs while inside of the device.

The simplest application of the cart 10 is as a passive containment device that may be used to house or store food stuffs for dynamic events requiring mobile storage, such as catering events, mobile food delivery, and the like. Heated, unheated, or even cold food items may be placed within the interior volumes 22 of cart 10 and then secured behind the respective door assemblies 16 so as to form an insulated compartment for the food stuffs. As discussed above, the side walls 12 and the door housing 50 of the cart 10 are preferably filled with Polyurethane foam, thus reducing the rate of heat transfer between the interior volume 22 of the cart 10 and an outside environment and keeping the food items at the same temperature at which they were placed within the cart 10. The food items may be placed on any number of trays 28 or other food service items in a multitude of positions as dictated by the tray rails 26 and rail guides 24, or simply within the interior volume 22 itself. The casters 18 coupled to the bottom of the cart 10 allow the cart 10 to be mobile and to be pushed or pulled where needed, for example in or out of a delivery truck, or in or out of an operating venue.

Another specific use for the cart 10 is as a heating containment device. In this embodiment, food items are placed within the cart 10 as described above, however after doing so, the heating insert 64 of the cart 10 is activated so as to apply heat to the contents of the interior volume 22. The heating insert 64 may be activated by either plugging a standard power cord coupled to an outside power source into the power socket 70 disposed in the front of the door assembly 16 or by activating a power switch as is known in the art. With power being supplied to the heating insert 64, the power LED 66 is illuminated notifying the user a successful power connection between the outside power source and cart 10 has been achieved. When heat is being generated by the heating insert 64, the heater LED 68 is illuminated notifying the user heat is being applied to the contents within the cart 10. In an alternative embodiment, the heating LED 68 becomes illuminated after the thermometer 62 which is electronically coupled to the heating insert 64 reaches a predetermined threshold temperature. This informs the user that the interior volume(s) 22 of the cart 10 have reached a desired temperature and is available for maintaining food items at that specific temperature. The heating insert 64 may be set to apply a fixed amount of heat, or alternatively it may comprise means for being adjusted to a plurality of user-defined settings.

Many alterations and modifications may be made by those having ordinary skill in the art without departing from the spirit and scope of the embodiments. Therefore, it must be understood that the illustrated embodiment has been set forth only for the purposes of example and that it should not be taken as limiting the embodiments as defined by the following embodiments and its various embodiments.

Therefore, it must be understood that the illustrated embodiment has been set forth only for the purposes of example and that it should not be taken as limiting the embodiments as defined by the following claims. For example, notwithstanding the fact that the elements of a claim are set forth below in a certain combination, it must be expressly understood that the embodiments includes other combinations of fewer, more or different elements, which are disclosed in above even when not initially claimed in such combinations. A teaching that two elements are combined in a claimed combination is further to be understood as also allowing for a claimed combination in which the two elements are not combined with each other, but may be used alone or combined in other combinations. The excision of any disclosed element of the embodiments is explicitly contemplated as within the scope of the embodiments.

The words used in this specification to describe the various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the embodiments.

I claim:

1. A mobile serving cart with a plurality of adjustable hinges comprising:

a plurality of side walls; and a plurality of door assemblies removably coupled to at least one of the plurality of side walls, wherein the plurality of door assemblies and the plurality of side walls cooperate to form a plurality of adjustable hinge assemblies, each hinge assembly comprising a cart bolt coupled to one of the plurality of side walls which is disposed between a pair of door bolts coupled to one of the plurality of door assemblies, and wherein the cart bolt and the pair of door bolts each comprise a pivoted core disposed in the center of a spherical bearing within each cart bolt and door bolt, the pivoted core being maneuverable with respect to the spherical bearing within each of the cart bolt and pair of door bolts.

2. The mobile serving cart of claim 1 wherein in each hinge assembly, the cart bolt coupled to the side wall is orthogonally orientated with respect to the pair of door bolts coupled to the door assembly.

3. The mobile serving cart of claim 1 wherein in each hinge assembly, the cart bolt and the pair of door bolts comprise means for being coupled to the side wall and the door assembly respectively at a continuous plurality of depths.

4. The mobile serving cart of claim 1 wherein each hinge assembly further comprises a pivot rod threaded through a circular aperture defined in each of the door bolts and the cart bolt.

5. The mobile serving cart of claim 4 further comprising means for locking the pivot rod in a fixed position threaded through the circular apertures defined in each of the door bolts and the cart bolt.

6. The mobile serving cart of claim 1 where the plurality of side walls and the plurality of door assemblies are thermally insulated.

7. The mobile serving cart of claim 1 wherein each of the plurality of side walls and each of the plurality of door assemblies are filled with Polyurethane foam.

8. The mobile serving cart of claim 1 further comprising:

at least one internal volume;

a plurality of rail guides coupled to an inner surface within the internal volume; and a plurality of tray rails removably coupled to the rail guides, wherein each of the plurality of tray rails are configured to accommodate at least a portion of a tray.

9. The mobile serving cart of claim 8 wherein the rail guides comprise an upper tip and a lower tip which are configured to interact with an upper mold and a lower mold, respectively, wherein the upper mold and the lower mold are disposed on the inner surface within the internal volume.

10. The mobile serving cart of claim 8 wherein the rail guides comprise a plurality of slots, and wherein the tray rails comprise an upper tab and a lower tab, the upper tab configured to be inserted into one of the plurality of slots and the lower tab configured to be inserted into a slot disposed directly beneath the slot accommodating the upper tab.

11. A mobile serving cart with a plurality of adjustable hinges comprising:

a plurality of side walls, wherein each of the plurality of side walls is filled with Polyurethane foam;

a plurality of door assemblies removably coupled to at least one of the plurality of side walls, wherein each of the plurality of door assemblies is filled with Polyurethane foam;

a plurality of rail guides coupled to an inner surface of at least one of the plurality of side walls; and a plurality of tray rails removably coupled to the rail guides, wherein the door assemblies and side walls cooperate to form a plurality of adjustable hinge assemblies, each hinge assembly comprising a cart bolt coupled to the side wall which is disposed between a pair of door bolts coupled to the door assembly, and wherein the cart bolt and the pair of door bolts each comprise a pivoted core disposed in the center of a spherical bearing within each cart bolt and door bolt, the pivoted core being maneuverable with respect to the spherical bearing within each of the cart bolt and pair of door bolts.

* * * * *